US007997683B2

(12) United States Patent
Mealy et al.

(10) Patent No.: US 7,997,683 B2
(45) Date of Patent: Aug. 16, 2011

(54) DEVICE FOR SERVICING AN INKJET PRINT HEAD ON A HAND HELD PRINTER

(75) Inventors: James Mealy, Austin, TX (US); Jonathan Neal Andrews, McMinnville, OR (US); Asher Simmons, Corvallis, OR (US)

(73) Assignee: Marvell International Ltd. (BM)

( * ) Notice: Subject to any disclaimer, the term of this patent is extended or adjusted under 35 U.S.C. 154(b) by 635 days.

(21) Appl. No.: 12/041,460

(22) Filed: Mar. 3, 2008

(65) Prior Publication Data

US 2008/0211864 A1 Sep. 4, 2008

Related U.S. Application Data

(60) Provisional application No. 60/892,698, filed on Mar. 2, 2007.

(51) Int. Cl.
*B41J 2/165* (2006.01)
*B41J 3/36* (2006.01)

(52) U.S. Cl. ..... 347/33; 347/29; 347/31; 347/32; 347/109

(58) Field of Classification Search ..... 347/29, 347/32, 33, 109
See application file for complete search history.

(56) References Cited

U.S. PATENT DOCUMENTS

| | | | | |
|---|---|---|---|---|
| 3,469,422 | A | 9/1969 | Minton | |
| 4,387,579 | A | 6/1983 | Branke et al. | |
| 4,557,194 | A | 12/1985 | Zimmer | |
| 5,450,105 | A * | 9/1995 | Dangelo | 347/30 |
| 5,563,637 | A * | 10/1996 | Francis et al. | 347/32 |
| 5,627,574 | A * | 5/1997 | Fahy | 347/33 |
| 5,644,346 | A * | 7/1997 | Schwiebert et al. | 347/33 |
| 5,682,186 | A * | 10/1997 | Bohorquez et al. | 347/29 |
| 5,714,971 | A * | 2/1998 | Shalit et al. | 715/804 |
| 5,793,388 | A * | 8/1998 | Martinson et al. | 347/19 |
| 5,825,995 | A | 10/1998 | Wiklof et al. | |
| 5,966,146 | A * | 10/1999 | Lee | 347/33 |
| 6,030,582 | A | 2/2000 | Levy | |
| 6,217,017 | B1 | 4/2001 | Yamazaki | |
| 6,309,044 | B1 * | 10/2001 | Gaarder | 347/32 |
| 6,332,677 | B1 | 12/2001 | Steinfield et al. | |
| 6,357,939 | B1 | 3/2002 | Baron | |
| 6,390,249 | B2 | 5/2002 | Tachibana | |
| 6,578,949 | B2 * | 6/2003 | Takahashi et al. | 347/30 |

(Continued)

FOREIGN PATENT DOCUMENTS

EP 1 543 981 A3 7/2006

(Continued)

OTHER PUBLICATIONS

GB Search Report for GB Application No. 0610837.7, dated Oct. 31, 2006, 2 pages.

(Continued)

*Primary Examiner* — Ryan Lepisto

(57) ABSTRACT

A hand-held printer that includes an inkjet array having a plurality of inkjets is disclosed. The hand-held printer may include an inkjet cap sized to cooperatively engage the inkjet array, wherein the inkjet cap is movable between and open position and a closed position, and a plurality of wipers carried by the inkjet cap, wherein each of the plurality of wipers is configured to engage one of the plurality of inkjets as the inkjet cap moves from the open position to the closed position; and wherein each of the plurality of wipers includes a gasket configured to form a seal adjacent to one of the plurality of inkjets.

18 Claims, 6 Drawing Sheets

U.S. PATENT DOCUMENTS

| | | | | |
|---|---|---|---|---|
| 6,580,244 | B2 | 6/2003 | Tanaka et al. | |
| 6,595,618 | B1 * | 7/2003 | Roy et al. | 347/32 |
| 6,682,190 | B2 | 1/2004 | Rasmussen et al. | |
| 6,789,869 | B2 | 9/2004 | Takeishi | |
| 6,851,878 | B2 | 2/2005 | Hemmerlin | |
| 6,896,349 | B2 | 5/2005 | Valero et al. | |
| 6,933,889 | B1 | 8/2005 | Wolf et al. | |
| 6,942,335 | B2 | 9/2005 | Trent | |
| 6,951,778 | B2 | 10/2005 | Akhavain et al. | |
| 6,952,284 | B2 | 10/2005 | Andrews et al. | |
| 7,316,466 | B2 * | 1/2008 | Uwagaki et al. | 347/33 |
| 7,552,994 | B2 * | 6/2009 | Hsu | 347/32 |
| 2001/0024216 | A1 * | 9/2001 | Kim | 347/33 |
| 2003/0043226 | A1 * | 3/2003 | Balcan et al. | 347/32 |
| 2004/0212682 | A1 | 10/2004 | Silverbrook | |
| 2004/0252051 | A1 | 12/2004 | Johnson | |
| 2006/0216043 | A1 | 9/2006 | Evans | |
| 2006/0279784 | A1 | 12/2006 | Carlson et al. | |
| 2007/0009277 | A1 | 1/2007 | Shoen | |
| 2007/0041052 | A1 | 2/2007 | Silverbrook et al. | |
| 2007/0080494 | A1 | 4/2007 | Marshall et al. | |
| 2008/0213018 | A1 | 9/2008 | Mealy et al. | |
| 2008/0215286 | A1 | 9/2008 | Mealy et al. | |

FOREIGN PATENT DOCUMENTS

| | | | |
|---|---|---|---|
| WO | WO 2003/055689 | A1 | 7/2003 |
| WO | WO 2004/056577 | A1 | 7/2004 |
| WO | WO 2005/070684 | A1 | 8/2005 |

OTHER PUBLICATIONS

HP Ink Jet Printer Cartridge Anatomy, http://wandel.ca.hp45_anatomy/index.html, printed Apr. 19, 2007, pp. 1-8.

International Search Report mailed Jul. 28, 2008, for International Application No. PCT/US2008/55636.

U.S. Appl. No. 11/952,849 entitled, "Handheld Tattoo Printer", filed on Dec. 7, 2007, 43 pages.

U.S. Appl. No. 12/036,862, entitled, "Print Head Configuration for Hand-Held Printing", filed on Feb. 25, 2008, 32 pages.

U.S. Appl. No. 12/039,491 entitled, "Cap Design for an Inkjet Print Head With Hand-Held Imaging Element Arrangement With Integrated Cleaning Mechanism", filed on Feb. 28, 2008. 38 pages.

U.S. Appl. No. 12/041,466 entitled, "Ink Supply for a Hand-Held Ink Jet Printer", filed on Mar. 3, 2008, 38 pages.

U.S. Appl. No. 12/074,018 entitled, "Hand-Propelled Labeling Printer", filed on Feb. 28, 2008, 47 pages.

U.S. Appl. No. 12/074,123, entitled, "Managing Project Information with a Hand-Propelled Device", filed on Feb. 28, 2008, 50 pages.

U.S. Appl. No. 12/132,405 entitled, Device and Method for Dispensing White Ink, filed on Jun. 3, 2008, 37 pages.

U.S. Appl. No. 12/141,717, entitled, Hand-Held Printing Device and Method for Tuning Ink Jet Color for Printing on Colored Paper, filed on Jun. 18, 2008, 38 pages.

Written Opinion of the International Searching Authority mailed on Jul. 28, 2008, for International Application No. PCT/US2008/55636.

International Search Report mailed Jul. 22, 2008, for International Application No. PCT/US2008/55680, 2 pages.

Written Opinion of the International Searching Authority mailed on Jul. 22, 2008, for International Application No. PCT/US2008/55680, 3 pages.

Chinese Office Action dated Aug. 30, 2010 with English translation for corresponding Chinese Patent Application No. 200880006958.4.

* cited by examiner

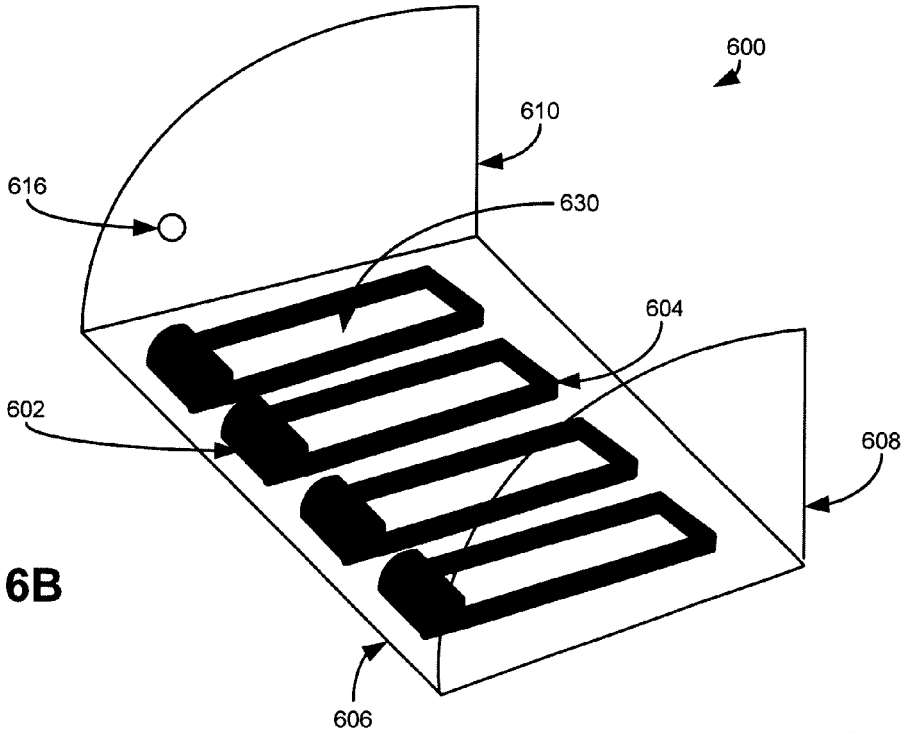
FIG. 6B
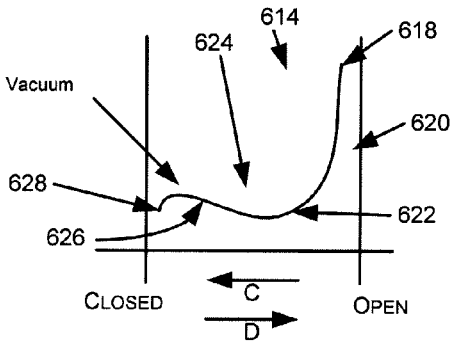
FIG. 6D
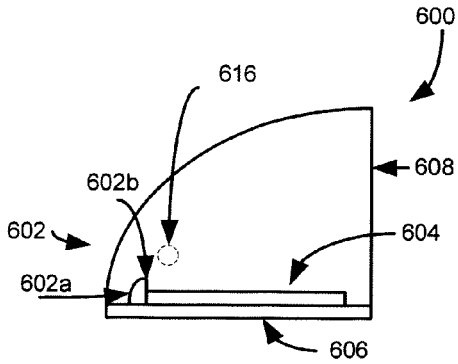
FIG. 6C
FIG. 6A
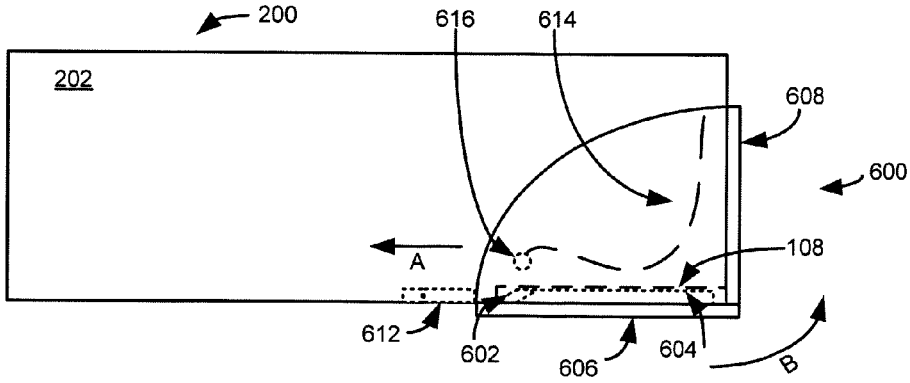

DEVICE FOR SERVICING AN INKJET PRINT HEAD ON A HAND HELD PRINTER

CROSS REFERENCE TO RELATED APPLICATIONS

This patent claims the priority benefit under 35 U.S.C. §119(e) of U.S. provisional application 60/892,698, filed on Mar. 2, 2007, entitled "SERVICING INKJET PRINT HEAD ON HAND-HELD PRINTER," the content of which is incorporated herein by reference for all purposes

BACKGROUND

Known printers often utilize a mechanically driven carriage to linearly propel, position and transport a print head to a desired position adjacent to a print medium. The print medium, in turn, is mechanically driven and positioned underneath and/or adjacent to the print head. During a print operation, the print head and the print medium are positioned relative to each other as an image is laid down.

Other known printers are designed and configured to be portable. For example, portable printers often include miniaturized components to reduce the overall weight and size of the device. Regardless of the size of these portable printers, the configuration and motion of the print head and the print medium operate in the same manner as the known printers discussed above. Thus, the print head and print medium drive mechanisms limit the size reduction of the printer as well as the material that may be used as the print medium.

SUMMARY

The present disclosure generally relates to hand-held printers and more particularly to hand propelled printers configured to service and maintain individual inkjets and/or an inkjet array. It would be desirable to provide a printer having increased portability and/or mobility over the known printers and portable printers. It would further be desirable to provide a mobile printer that may reduce and/or eliminate the need for the print head and print medium drive mechanisms utilized within the known printers and portable printers. Moreover, it would be desirable to provide a device and method for protecting and ensuring the functionality of the inkjet portion of the print head.

In one embodiment, a hand-held printer that includes an inkjet array having a plurality of inkjets is disclosed. The hand-held printer may include an inkjet cap sized to cooperatively engage the inkjet array, wherein the inkjet cap is movable between and open position and a closed position, and a plurality of wipers carried by the inkjet cap, wherein each of the plurality of wipers is configured to engage one of the plurality of inkjets as the inkjet cap moves from the open position to the closed position; and wherein each of the plurality of wipers includes a gasket configured to form a seal adjacent to one of the plurality of inkjets.

In another embodiment, a method for servicing an inkjet on a hand-held printer is disclosed. The method includes transitioning an inkjet cap from an open position to a closed position, sliding a wiper adjacent to an inkjet, wherein the wiper is carried by the inkjet cap and is configured to clean the inkjet, sealing a gasket portion of the wiper around the inkjet, and locking the inkjet cap in the closed position.

In another embodiment, a hand-held printer is disclosed. The hand-held printer includes means for capping an inkjet array wherein the means for capping is movable between and open position and a closed position, means for wiping the inkjet array, wherein the means for wiping is carried by the means for capping, and is configured to engage the inkjet array as the means for capping moves from the open position to the closed position, and means for sealing the inkjet array, wherein the means for sealing cooperates with the means for wiping when the means for capping is in the closed position.

Additional features and advantages of the disclosed hand-held printer are described in, and will be apparent from, the following Detailed Description and the figures.

BRIEF DESCRIPTION OF THE FIGURES

FIGS. 6A to 6D are exemplary views of a cap operable in conjunction with the hand-held printer shown in FIG. 2.

DETAILED DESCRIPTION

The embodiments and concepts discussed herein provide for a mobile or hand propelled printer having a compact size and suitable for printing on a wide variety of print mediums. The exemplary mobile printer eliminates the carriage and paper handling mechanisms and may include scanning and position sensors.

Figure 1:
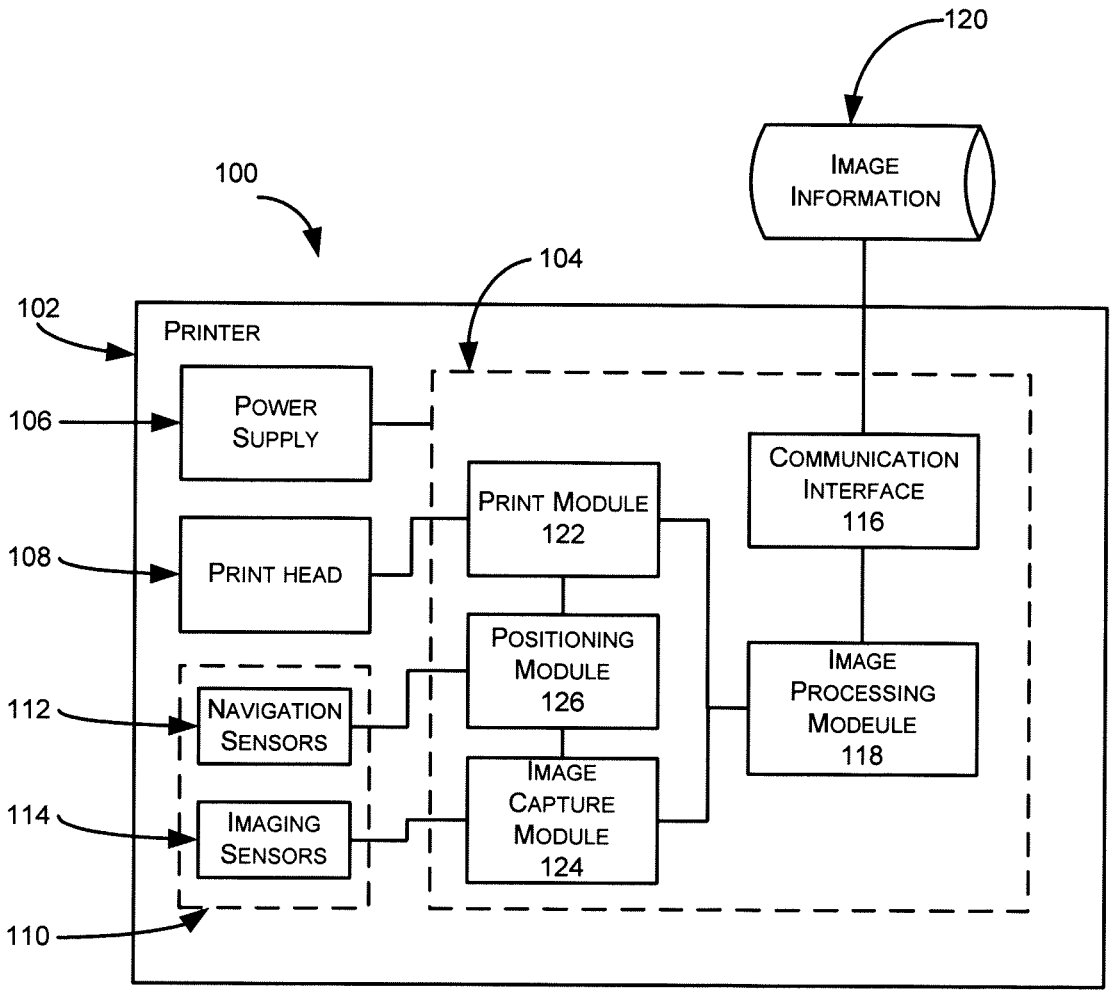
FIG. 1 is a logical schematic of a hand-held printer with accordance to the teachings disclosed herein.

FIG. 1 illustrates a logical schematic 100 of a mobile or hand propelled printer 102. As used herein, the terms printer, printing device, hand-held printer, mobile printer and hand propelled printer are intended to be synonymous and interchangeable. The printer 102 may include a controller 104 powered by a power supply 106 and in communication with a print head 108 and a sensor suite 110. The sensor suite 110, in this exemplary embodiment, may include one or more position or navigation sensors 112 and one or more optical imaging sensors 114. The controller 104 and the sensor suite 110 cooperate to facilitate precise and accurate positioning of the print head 108 throughout printing and/or scanning operations. Precise positioning allows the printer 102 to reliably produce or print images and scan or acquire images.

The controller 104 may include a communication interface or module 116 coupled to an image processing module 118 and an image information source 120. The image processing module 118 may, in turn, be communicatively coupled to a print module 122 and an image capture module 124. The print module 122 and image capture module 124 are, in this exemplary embodiment, communicatively coupled to a positioning module 126.

The image information source 120 may be any type of device capable of transmitting data related to an image, picture or file to be printed by the print head 108. The image information source 120 may include a general purpose computing device, e.g., a desktop computing device, a laptop computing device, a mobile computing device, a personal digital assistant, a cellular phone, etc. or it may be a removable storage device, e.g., a flash memory data storage device, designed to store data such as image data. If, for example, the image information source 120 is a removable storage device, e.g., a universal serial bus (USB) storage device, the communication interface 116 may include a port, e.g., a USB port, to engage and communicatively receive the storage device. In another embodiment, the communication interface 116 may include a wireless transceiver to allow for the wireless communication of image data between the image information source 120 and the controller 104. Alternatively, the communication interface 116 may facilitate creation of an infrared (IR) communication link, a radio-frequency (RF) communication link or any other known or contemplated communication system, method or medium.

The communication interface 116 may, in other alternate embodiments, be configured to communicate with the image information source 120 through one or more wired and/or wireless networks. The networks may include, but are not limited to, a personal area network (PAN), a local area network (LAN), a wireless local area network (WLAN), a wide area network (WAN), etc. The networks may be established in accordance with any number of standards and/or specifications such as, for example, IEEE 802.11x (where x indicates a, b, g and n, etc.), 802.16, 802.15.4, Bluetooth, Global System for Mobile Communications (GSM), code-division multiple access (CDMA), Ethernet, etc.

The image processor 118 may receive the image data from the communication interface 116 and process the received image data to facilitate the printing process. Alternatively, the processing of the image data may be performed by the image information source 120 or other device or module and communicated to the communication interface 116. The processed image data may, in turn, be provided to the print module 122. The print module 122 can cache or store the processed image data or may communicate the data in real-time for printing by the print head 108.

The positioning module 126 may provide position information to the print module 122. The position information may be utilized to calculate the relative position of the print head 108 to a reference point defined or established on the print medium or within the image data being printed and/or scanned. The position information may be generated or calculated by the positioning module 126 based on signals, measurements or other information received from the one or more navigation sensors 112. The navigation sensors 112 may, for example, be an optoelectronic sensor, an electromechanical sensor or one or more inertial sensors configured to provide location and direction information to the printer 102 and the print head 108. The location and directional information may, in turn, be utilized by the positioning module 126 to determine the precise location of the printer 102 and print head 108 relative to the surface of the print medium upon which the image data is to be reproduced. Print medium, as discussed herein, may be any type of material or medium on which a printing substance, e.g., ink, powder, etc., may be deposited.

The position information provided by the navigation sensors 112 may be utilized by the print module 122, via the positioning module 126, to coordinate the location of the print head 108 to a position within the processed image data provided by the image processing module 118. The print module 122 may then direct and control the print head 108 to dispense and deposit ink on the print medium to represent the corresponding portion of the processed image data.

The print head 108 may be an inkjet print head having a plurality of nozzles or primitives (see FIG. 2 for details) configured to dispense a printing substance, e.g., liquid ink droplets, on a print medium. The printing substance may be contained in reservoirs or cartridges. The reservoirs or cartridges may contain or store black ink, and/or cyan ink, magenta ink, yellow ink, and black ink. Other embodiments may utilize other printing techniques, e.g., toner-based printers such as laser or light-emitting diode (LED) printers, solid ink printers, dye-sublimation printers, inkless printers, etc.

The image capture module 124 may receive image information from the one or more optical imaging sensors 114. The optical imaging sensors 114 may be charge coupled devices (CCDs) configured and arranged to capture a plurality of images representative of the surface of the print medium or other scannable medium. The plurality of images may be processed by the image capture module 124 and reassembled to generate a representation of the print medium or scannable medium. The image capture module 124 may receive positioning information from the positioning module 126 to facilitate the arrangement and reassembly of the plurality of captured images provided by the optical image sensors 114. In this manner, the printer 102 may be utilized to scan, process, store and duplicate images via the cooperation of the image capture module 124, the positioning module 126 and the print module 122.

The image capture module 124 may, in another embodiment, be utilized to calibrate the positioning module 126. For example, an image captured by the optical image sensors 114 may be compared to the processed image data provided by the image processing module 118 to correct or compensate for accumulated positioning errors and/or to reorient the positioning module 126. For example, if the printer 102 is removed from the print medium during a printing procedure, the positioning module 126 may lose track of the reference point associated with the printing procedure.

Figure 2:
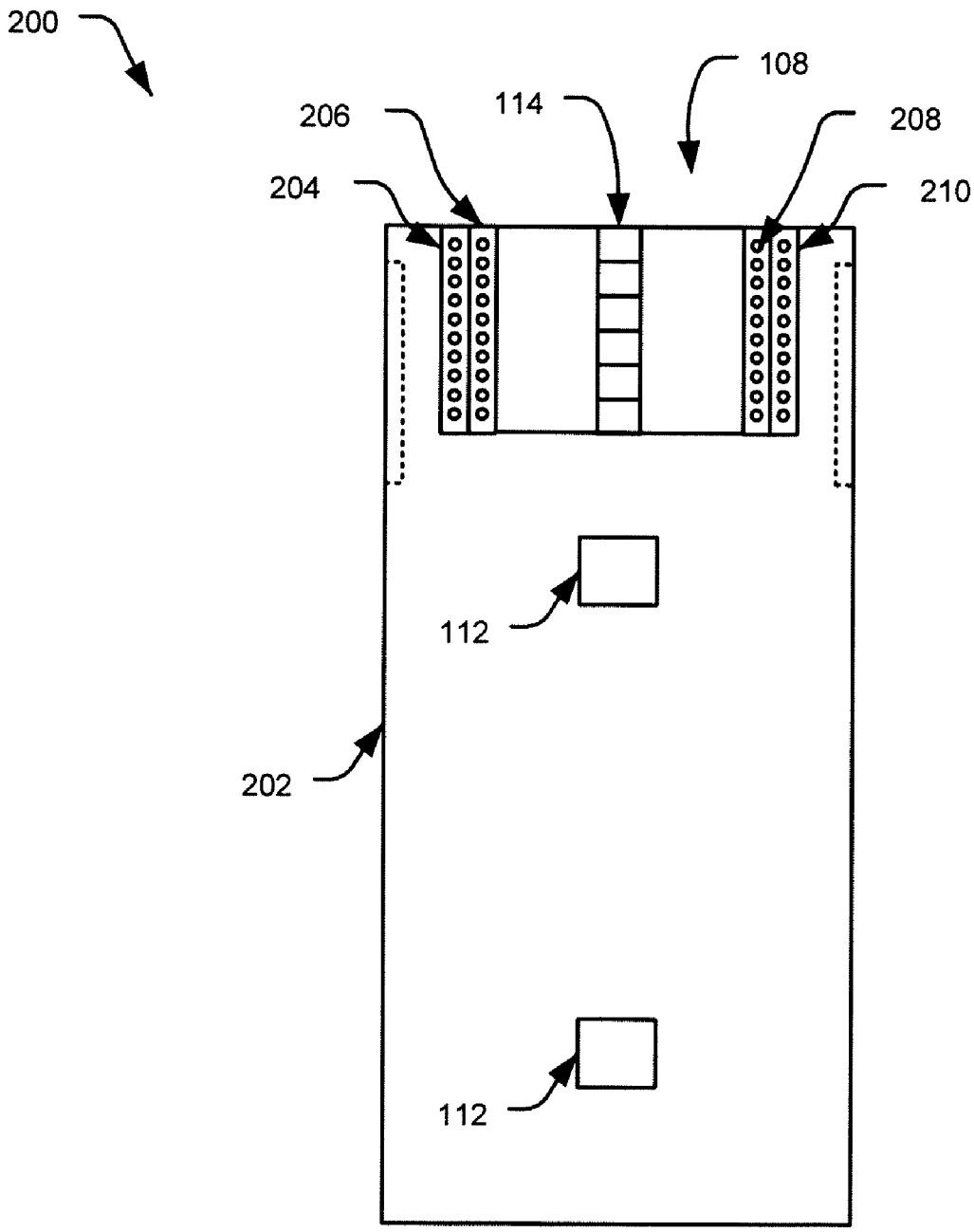
FIG. 2 is a bottom plan view of the hand-held printer discussed in conjunction with FIG. 1.

FIG. 2 illustrates a bottom plan view of a printing device 200 which may be constructed to include the teachings discussed in conjunction with the logical schematic 100 and the mobile or hand propelled printer 102. Thus, the components and elements of the printer 102 may be included in, or integral to, the printing device 200. For example, the printing device 200 includes a housing 202 that supports and carries the print head 108 and the sensor suite 110 including a pair of navigation sensors 112 and one or more optical image sensors 114.

The pair of navigation sensors 112 may be used by the positioning module 126 (see FIG. 1) to determine positioning information related to the optical imaging sensors 114 and/or the print head 108. The housing 202 supports the optical imaging sensors 114 and the print head 108 fixed relative to the pair of navigation sensors 112 such that the image and/or position information obtained by the navigation sensors 112 may be precisely correlated to the relative to the optical imaging sensors 114 and the print head 108.

The print head 108, in this exemplary embodiment, may be an inkjet print head having a number of nozzle rows for different colored inks. For example, if the print head 108 is a color (CMYK) print head, it may include a nozzle row 204 for cyan-colored ink (C), a nozzle row 206 for magenta-colored ink (M), a nozzle row 208 for yellow-colored ink (Y), and nozzle row 210 for black-colored ink (K). The nozzle rows or nozzles 204 to 210 of the print head 108 may be arranged adjacent to optical imaging sensors 114. This configuration allows the optical imaging sensors 114 to capture information about the ink deposited on the print medium by the print head 108 as it is dispensed. This information may be used for error correction and verification of the processed image data throughout the dispensing and/or printing processes.

The nozzles 204 to 210 in this exemplary embodiment are arranged according to color. For example, the arrangement and order of the colors stored within the nozzles 204 to 210 may be based on predetermined deposition orders and/or amounts necessary to create new colors by depositing and thereby mixing the colors stored within the nozzles 204 to 210. Utilization of different base or constituent colors, e.g., colors other than CMYK, may require a different nozzle order or arrangement to produce the desired colors, color combinations, etc.

Figure 3:
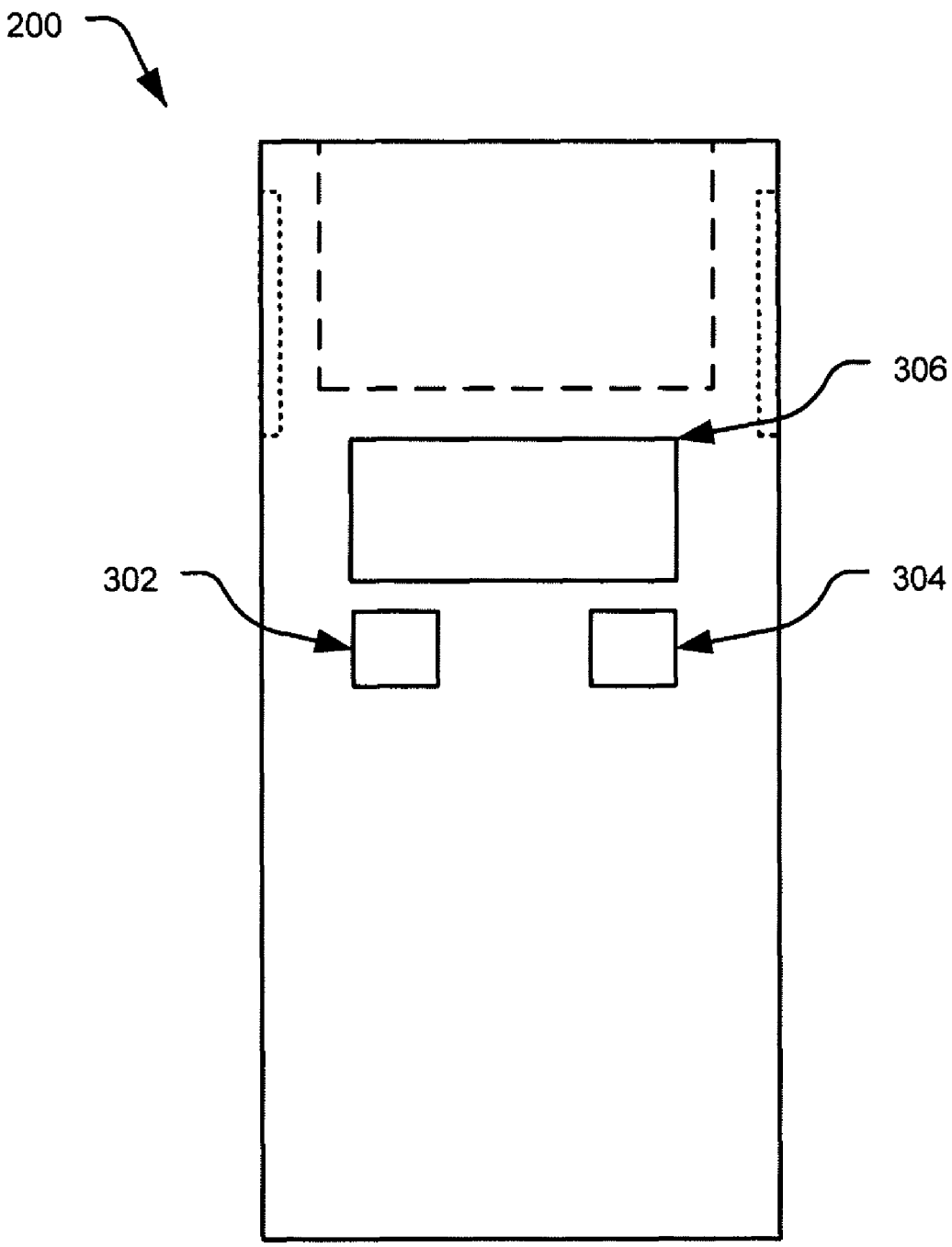
FIG. 3 is a top plan view of the hand-held printer shown in FIG. 2.

FIG. 3 illustrates is a top plan view of the printing device 200 shown in FIG. 2. The printing device 200 may include a variety of user controls, buttons, touch screens, etc., based on the functionality designed into or supported by the controller 104 shown in FIG. 1. For example, the printing device 200 includes a print control input 302, a scan control input 304 and a display 306 communicatively coupled to the controller 104. The print control input 302 may provide a signal to the controller 104 that can be utilized to initiate/resume a print operation. The scan control input 304 may provide a signal to the controller 104 that can be utilized to initiate/resume a scan operation.

The display 306, which may be a passive display, an interactive display, etc., may provide the user with a variety of information. The information may relate to the current operating status of the printing device 200 (e.g., printing, ready to print, scanning, ready to scan, receiving print image, transmitting print image, transmitting scan image, etc.), power of the battery, errors (e.g., scanning/positioning/printing error, etc.), instructions (e.g., "position device over a printed portion of the image for reorientation," etc.). If the display 306 is an interactive display it may provide a control interface in addition to, or as an alternative from, the control inputs 302 and 304.

Figure 4:
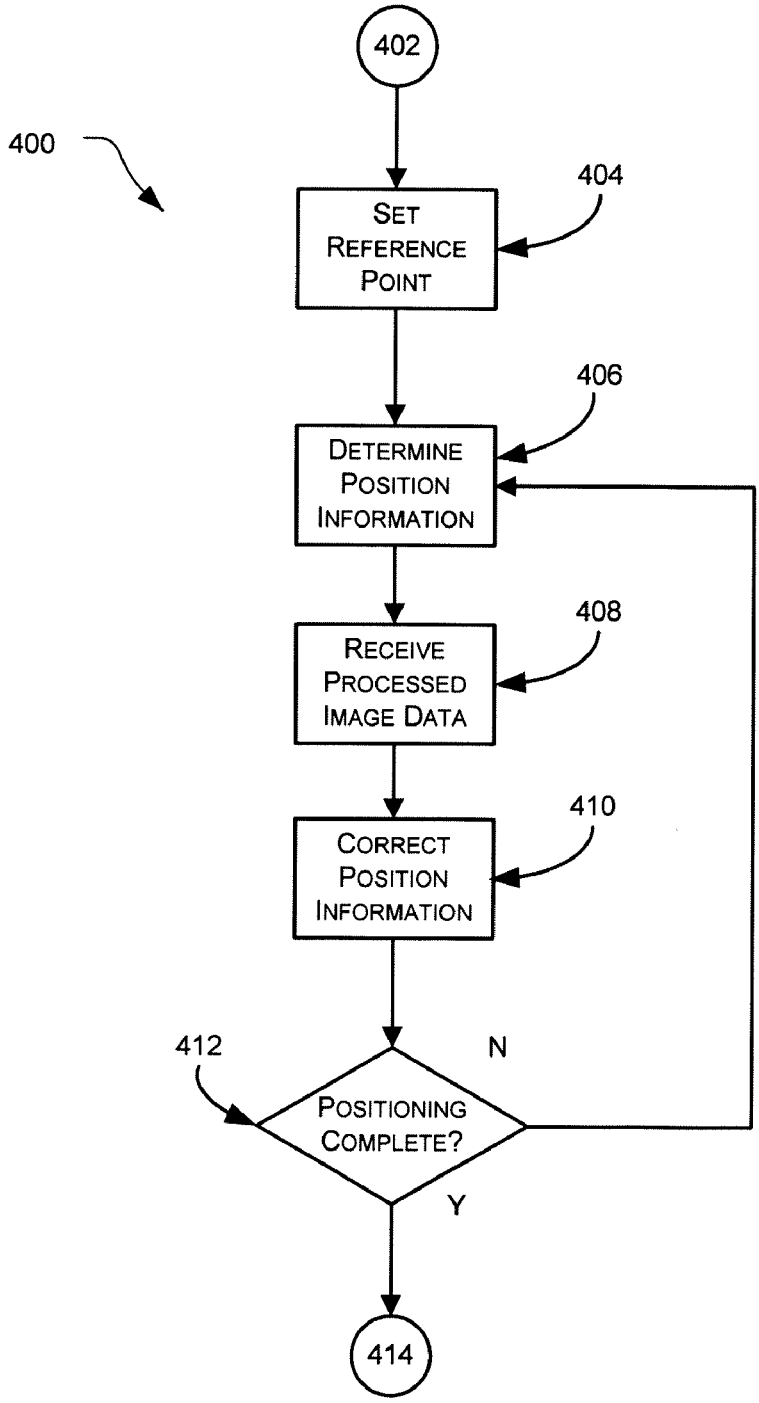
FIG. 4 is a flowchart describing an exemplary positioning operation that may be performed by the hand-held printer.

FIG. 4 depicts a flow diagram illustrating an exemplary positioning operation 400 that may be performed by the printing device 200 shown in FIG. 2. At block 402, the positioning operation 400 may begin with the initiation of a scanning or a printing operation. For example, the print control input 302 (see FIG. 3) may provide a signal to the controller 104 (see FIG. 1) to initiate a print operation, or the scan control input 304 (see FIG. 3) may provide a signal to the controller 104 to initiate a scan operation.

At block 404, a reference point on the printing medium may be established by the positioning module 126. For example, the user may be instructed via text or graphics provided by the display 306 to activate one of the inputs 302, 304 when the printing device 200 is positioned in a desired starting location. Alternatively, the user may preposition the printing device 200 in the desired starting location and orientation and the reference point may be established upon activation of the appropriate input 302, 304.

At block 406, the positioning module 126 may utilize information provided by the navigation sensors 112 to determine position information, e.g., translational and/or rotational changes relative to the reference point, for the printing device 200. The translational changes may be determined by tracking incremental changes of the positions of the navigation sensors along a two-dimensional coordinate system, e.g., $\Delta x$ and $\Delta y$. Rotational changes may be determined by tracking incremental changes in the angle of the printing device, e.g., $\Delta\theta$, with respect to, e.g., the y-axis. These transitional and/or rotational changes may be determined by the positioning module comparing consecutive navigational images taken by the navigation sensors 112 to detect these movements.

At block 408, the positioning module 126 may further receive the processed image data from the image processing module 118. If all or part of an image has been previously deposited or printed at a given location, the optical image sensors 114 may be utilized to verify the accuracy of the calculated position location with respect to the received processed image data. For example, the optical image sensors 114 may sample the deposited image (or image to be scanned) and compare that sample to a corresponding position within the received processed image data. This verification process may further note and compensate for images in which the printing and/or deposition is incomplete.

At block 410, the positioning module 126 may correct for differences and deviations between the calculated position location and the received processed image data. For example, with enough information, e.g., sufficient material deposited in the location scanned by the optical image sensors 114, the positioning module 126 may offset and align the position information ensure that the two images match. If the positioning module 126 is unable to determine an appropriate offset based on the available information, the optical image sensors 114 may be utilized to gather more information, identify patterns, etc. The additional information and/or patterns may, in turn, be utilized by the positioning module 126 to determine the offset necessary to align the calculated position location and the received processed image data. Correction and compensation may be performed continually or periodically based on, for example, image complexity, available processing power, desired resolution, etc.

At block 412 the status of the positioning operation 400 and calculations may be evaluated. If the position information is determined to be accurate, then at block 414 the positioning operation 400 may be completed. If the position information is incomplete, inaccurate or otherwise unacceptable, then positioning operation 400 may return to block 406 and begin the process again.

Figure 5:
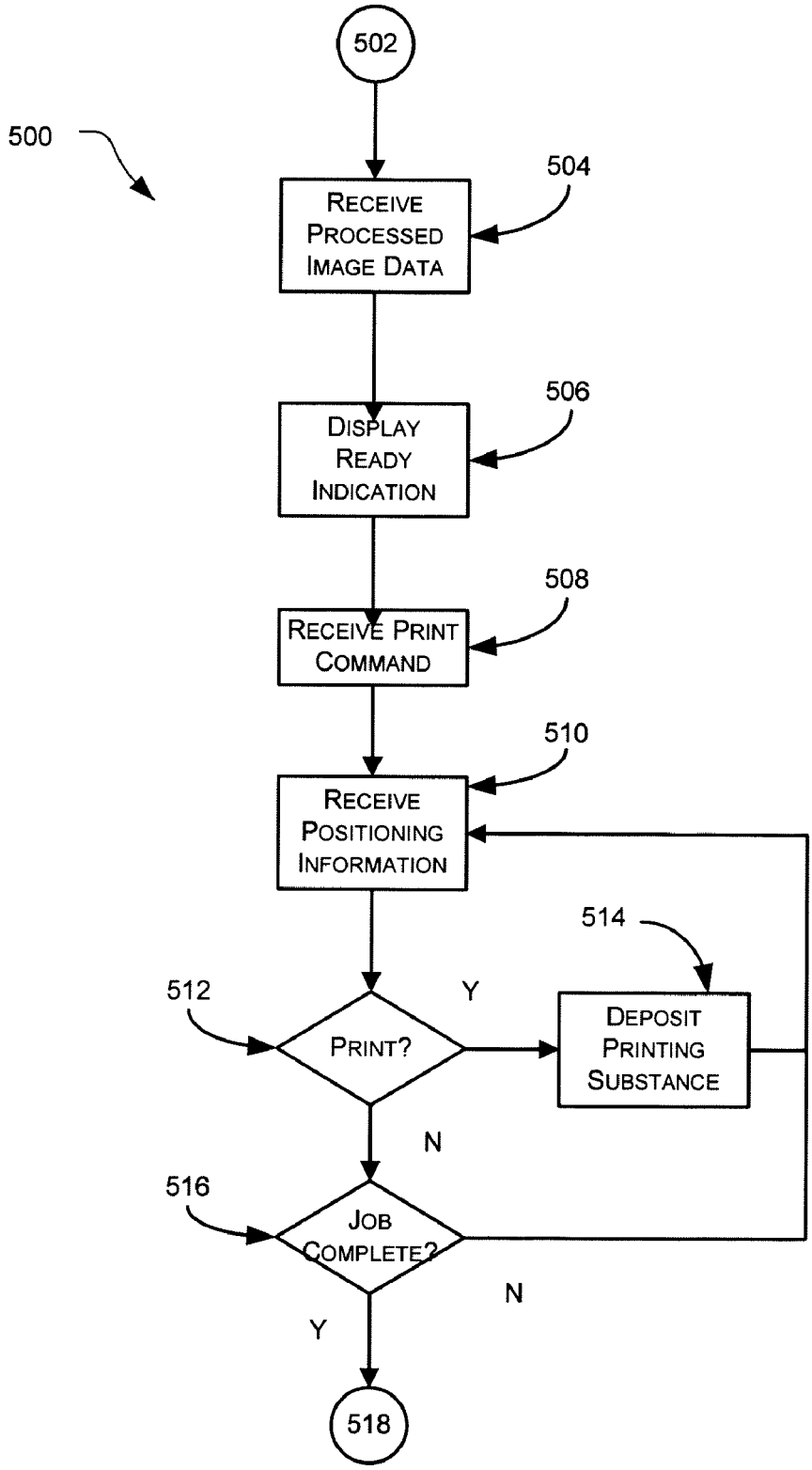
FIG. 5 is a flow diagram describing an exemplary printing operation that may be performed by the hand-held printer.

FIG. 5 depicts a flow diagram illustrating a printing operation 500 that may be performed by the printing device 200. At block 502, the printing operation 500 may begin or be initiated by, for example, a signal provided by the print control input 302.

At block 504, the print module 122 may receive processed image data from the image processing module 118. As previously discussed, the image data may be received in a raw or unprocessed format from the image information source 120 and processed for printing by the image processing module 118. Alternatively, the image data may be preprocessed by the image information source 120 and communicated to the print module 122 as discussed in connection with FIG. 1.

At block 506, the display 306 may indicate that the printing device 200 is ready to print the processed image data. The display 306 may also provide a thumbnail representation of the processed image data. The thumbnail image provided by the display 306 may be utilized to indicate the status of the printing operation 500. For example, thumbnail image may be erased, shaded or otherwise modified as the printing device 200 dispenses and prints the processed image data on a print medium.

At block 508, the print module 122 may receive a signal representative of a print command generated from a user activating the print control input 302 in block 516.

At block 510, the print module 122 may further receive positioning information from the positioning module 126.

At block 512, the print module 122 may then determine whether to deposit printing substance, e.g., one or more colors of ink, at the given location on the surface of the print medium. For example, the determination to print or deposit ink may be a function of the total drop volume to be placed at a given location on the surface of the print medium and the drop volume previously deposited at that location. If additional printing or deposition is to occur, then at block 514 the print module 122 may cause the print head 108 to dispense an appropriate amount of the printing substance as the printing device 200 is moved or propelled across the surface of the print medium by the user. The printing operation 500 may, in turn, return to the block 510 to receive additional positioning information in preparation for further deposition.

If no additional printing or deposition is to occur, then at block 516, the printing operation 500 may determine if the print job has been completed. The determination of whether the print job is complete may be a function of the printed volume versus the total print volume. Alternatively, the determination to end the printing operation 500 may be reached even if the printed volume is less than the total print volume. For example, the end of the printing operation 500 may occur when the printed volume is ninety-five percent (95%) of the total print volume. If the print job is completed, then at block 518 the printing operation 500 ends. If the print job is not complete, then the printing operation 500 may return to the block 510 to receive additional positioning information in preparation for further deposition.

FIGS. 6A to 6D illustrate a movable or retractable cap 600 that may be utilized in conjunction with the printing device 200. In particular, the movable cap 600 may be sized and configured to cooperatively engage the housing 202 adjacent to the print head 108. As shown in FIG. 6A, when the cap 600 is disposed in the closed position, the cap 600 abuts or engages the print head 108. In particular, the print head 108 may be carried within a recessed portion of the housing 202 in order to protect and properly aligned the nozzles 204 to 210 relative to the surface of the print medium upon which the printing substance is to be dispensed. The cap 600 carries a plurality of wipers 602 and gaskets 604 (see FIG. 6B) configured to clean and engage the nozzles 204 to 210 when the cap 600 is disposed in the closed position.

FIG. 6B illustrates an enlarged perspective view of the cap 600 and the plurality of wipers 602 and gaskets 604. The cap 600 may include a base 606 sized to carry the plurality of wipers 602 and gaskets 604. Each of the wipers 602, as shown in FIG. 6C, includes a leading edge 602*a* and a trailing edge 602*b*. The leading edge 602*a* may be a curvilinear edge configured to wipe the nozzles 204 to 210 as the cap 600 closes. The wiping action of the leading edge 602*a* removes excess ink and/or printing substance which may accumulate near the nozzles 204 to 210. The trailing edge 602*b* may be a sharp edge or transition configured to rake nozzles 204 to 210 as the cap 600 is opened. The raking action of the trailing edge removes or breaks up any dried or accumulated printing substance and/or ink that may clog or interfere with the operation of the nozzles 204 to 210.

In one embodiment, the wiper 602 and gasket 604 may be formed as one continuous piece and configured to engage each of the nozzles 204 to 210 simultaneously. Alternatively and as shown in FIG. 6B, the wiper 602 and gasket 604 may be formed as discrete pieces or elements. In this arrangement, each nozzle 204 to 210 is paired or mated with a separate wiper 602 and gasket 604 to ensure each nozzle and printing substance is enclosed and isolated. The wipers 602 and gaskets 604 may be formed or molded from a variety of deformable plastics and/or rubber materials (for example EPDM, Viton, or something similar). The deformation of the wiper 602 and gasket 604 allows for the creation of a seal (see FIG. 6A) between the cap 600 and the print head 108 when the cap is secured or disposed in the closed position.

The base 606 may support a pair of sides 608, 610 arranged substantially perpendicular to the surface of the base 606. The arrangement of the base 606 and the sides 608, 610 defines a substantially U-shaped interior sized to enclose or engage the housing 202 adjacent to the print head 108. As shown in FIG. 6A, when the cap 600 is in the closed position, the side 608 and the base 606 abut or engage the housing 202.

The cap 600 may be secured adjacent to the print head 108 via a lock 612. By releasing the lock 612 in the direction indicated by the arrow A, the cap 600 may be free to pivot or rotate about the housing 202 in the direction indicated by the arrow B. For example, the sides 608 and 610 may remain in sliding contact with the housing 202 while the base 606, wipers 602 and gaskets 604 disengage and clean the nozzles 204 to 210 as the cap 600 moves from the closed position (shown in FIG. 6A) to an open position (not explicitly shown but away from the nozzles 204 to 210).

The movement of the cap 600 may, for example, be controlled or guided by a cam 614. The cam 614 may be formed within the sides of the housing 202 or may be formed within the sides 608, 610 of the cap 600. It will be understood that regardless of the component in which the cam 614 is formed, an appropriate cam follower 616 will be formed on the mating component. The cam 614 represents one method of controlling and guiding the movement of the cap 600 between the closed position (shown in FIG. 6A) and an open position that allows the nozzles 204 to 210 to freely dispense the printing substance and/or ink.

FIG. 6D illustrates a representation of the guide or cam 614 controlling the movement of the cap 600. In this exemplary embodiment, the cam 614 controls the overall movement of the cap 600 as the cam follower 616 move or translates in the general direction indicated by the arrow C. For example, as the cap 600 moves from the open position 618, the cam 614 guides the cam follower 616 along the transition path 620 to a position near the print head 108. At or about the point indicated by the reference numeral 622, the leading edge 602*a* of the wiper 602 comes into contact with the nozzles 204 to 210. The contact initiates the wiping or cleaning of the nozzles 204 to 210 by the leading edge 602*a* as the cam follower 616 and the cap 600 along the wiping path 624 defined between the point 622 and the point 626. At the point 626, the wiping action is complete and the wiper 602 and leading edge 602*a* begin to deform and engage the surface of the nozzles 204 to 210 as the cap 600 is moved into close contact with the housing 202 by the motion of the cam follower 616.

The deformation of the wiper 602 and the leading edge 602*a* allow the gasket 604 to contact and seal against the nozzles 204 to 210. The seal formed by the cooperation of the wiper 602 and gasket 604 may prevent the printing substance within the nozzle 204 to 210 from become dry and forming clots. At the point 626, the wiper 602 and gasket 604 may further compress against the nozzles 204 to 210 as the cap 600 moves into closer contact with the housing 202. The further compression may force and/or remove air from within the seal. As the cam follower 616 moves the cap 600 towards the point 628, the compression of the sealed wiper 602 and gasket 604 decreases. The decrease in compression coincides with an increase in the internal volume of the space 630 formed by the cooperation of the wipe 602 and the gasket 604 while maintaining the amount of air trapped within the sealed space 630. The increased volume of the space 630 along with the constant amount of air contained therein, results in a lowering of the pressure within the space 630. The lowered pressure, in turn, serves to keep the nozzles 204 to 210 moist and ready to dispense.

It will be understood that the by reversing the movement of the cap 600 and cam follower 616, e.g., by releasing the lock or catch 612, in the general direction indicated by the arrow D, the sealing and closing processes can be reversed. During this opening procedure, the trailing edge 602*b* rakes against the nozzles 204 to 210 as the cap 600 and cam follower 616 move from the point 626 to the point 622.

In another embodiment, the cam 614 and the cam follower 616 may be a spring loaded system. Spring loading could allow the cap 600 and wiper 602 to engage/disengage the nozzles 204 to 210 at different speeds. For example, as the cam 616 and cap 600 follower move from point 622 to point 626 (see arrow C), a spring (not shown) may be compressed. The compression of the spring (not shown) may slow the movement of the wiper 602 carried by the cap 600. As the cam 616 and cap 600 follower move from point 626 to point 622 (see arrow D), the spring (not shown) may be expand. The expansion of the spring (not shown) releases the energy stored therein and quickly drives the wiper 602 carried by the cap 600 towards the open position.

In another embodiment, the cam 614 may simply guide the cap 600 towards the lock 612. The lock 612 in this exemplary embodiment may be a spring loaded lock configured to engage the leading edge of the base 606. For example, when the leading edge of the base 606 engages the lock 612, the spring portion of the lock is compressed. Compression of the spring causes the deformation of the wiper 602 and the gasket 604, and causes the lock 612 to engage the base 606. Upon release of the now-engaged base 606, the compression on the spring may relax which, in turn, causes the expansion of the space 630 and the desired pressure drop therein.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

What is claimed is:

1. A hand-held printer comprising:

an inkjet cap sized to cooperatively engage an inkjet array, wherein the inkjet cap is movable between an open position and a closed position;

a plurality of wipers carried by the inkjet cap; and a plurality of gaskets, each gasket of the plurality of gaskets abutting at least one wiper of the plurality of wipers, wherein at least one wiper of the plurality of wipers is configured to engage at least one inkjet of a plurality of inkjets within the inkjet array as the inkjet cap moves from the open position to the closed position; and wherein at least one gasket of the plurality of gaskets is configured to form a seal adjacent to at least one inkjet of the plurality of inkjets.

2. The hand-held printer of claim 1 further comprising:

a lock mechanism configured to releasably engage the inkjet cap and maintain the inkjet cap in the closed position.

3. The hand-held printer of claim 1 further comprising:

a cam slideably coupled to the inkjet cap, wherein the cam is configured to guide the inkjet cap and the plurality of wipers through a wipe phase and a seal phase as the inkjet cap moves between the open position and the closed position.

4. The hand-held printer of claim 3, wherein the cam is configured to guide the inkjet cap such that the inkjet cap at least partially rotates as the inkjet cap moves between the open position and the closed position.

5. The hand-held printer of claim 1, wherein each wiper of the plurality of wipers includes a leading edge and a trailing edge.

6. The hand-held printer of claim 5, wherein the leading edge defines a curvilinear surface.

7. The hand-held printer of claim 5, wherein the trailing edge defines a sharp edge.

8. The hand-held printer of claim 1, wherein each wiper of the plurality of wipers is configured to wipe and at least partially seal one inkjet of the plurality of inkjets.

9. The hand-held printer of claim 1, wherein the at least one wiper and the at least one gasket are a unitary part.

10. The hand-held printer of claim 1, wherein the plurality of gaskets is carried by the inkjet cap.

11. The hand-held printer of claim 1, wherein each wiper of the plurality of wipers is configured to engage at least one inkjet of the plurality of inkjets, and wherein each gasket of the plurality of gaskets is configured to form a seal adjacent to at least one inkjet of the plurality of inkjets.

12. A hand-held printer comprising:

means for capping an inkjet array wherein the means for capping is movable between an open position and a closed position;

means for wiping the inkjet array, wherein the means for wiping is carried by the means for capping, and is configured to engage the inkjet array as the means for capping moves from the open position to the closed position;

means for sealing the inkjet array, wherein the means for sealing cooperates with the means for wiping when the means for capping is in the closed position;

wherein the cooperation between the means for sealing and the means for wiping comprises the means for sealing abutting the means for wiping.

13. The hand-held printer of claim 12 further comprising:

means for locking configured to secure the means for capping in the closed position.

14. The hand-held printer of claim 12 further comprising:

means for guiding the means for capping and the means for wiping through a wipe phase and a seal phase as the means for capping moves between the open position and the closed position.

15. The hand-held printer of claim 12, wherein the means for wiping includes a leading edge and a trailing edge.

16. The hand-held printer of claim 15, wherein the leading edge defines a curvilinear surface.

17. The hand-held printer of claim 15, wherein the trailing edge defines a sharp edge.

18. The hand-held printer of claim 12, wherein the means for capping at least partly rotates as the means for capping moves between the open position and the closed position.

* * * * *